US010125003B2

(12) United States Patent
Yui et al.

(10) Patent No.: US 10,125,003 B2
(45) Date of Patent: Nov. 13, 2018

(54) BOTTOM-LOADING BOTTLED WATER DISPENSERS WITH HOT WATER SANITIZING FEATURES

(71) Applicants: George Yui, Toronto (CA); Andrei Yui, Toronto (CA)

(72) Inventors: George Yui, Toronto (CA); Andrei Yui, Toronto (CA)

( * ) Notice: Subject to any disclaimer, the term of this patent is extended or adjusted under 35 U.S.C. 154(b) by 0 days.

(21) Appl. No.: 14/857,521

(22) Filed: Sep. 17, 2015

(65) Prior Publication Data

US 2016/0362286 A1 Dec. 15, 2016

Related U.S. Application Data

(63) Continuation-in-part of application No. 14/751,081, filed on Jun. 25, 2015.

(60) Provisional application No. 62/173,307, filed on Jun. 9, 2015.

(51) Int. Cl.

| | |
|---|---|
| ***B67D 7/80*** | (2010.01) |
| ***B67D 1/00*** | (2006.01) |
| ***B67D 1/07*** | (2006.01) |
| ***B67D 3/00*** | (2006.01) |

(Continued)

(52) U.S. Cl.

CPC ..... *B67D 1/0009* (2013.01); *B67D 1/07* (2013.01); *B67D 1/0888* (2013.01); *B67D 1/0895* (2013.01); *B67D 3/0009* (2013.01); *B67D 3/0022* (2013.01); *B67D 3/0038* (2013.01); *B67D 1/0859* (2013.01); *B67D 1/1277* (2013.01); *B67D 2001/075* (2013.01); *B67D 2001/1261* (2013.01); *B67D 2001/1263* (2013.01); *B67D 2210/0001* (2013.01); *B67D 2210/00013* (2013.01); *B67D 2210/00015* (2013.01); *B67D 2210/00026* (2013.01); *B67D 2210/00154* (2013.01); *B67D 2210/00157* (2013.01)

(58) Field of Classification Search

CPC ..... B67D 1/0009; B67D 1/07; B67D 1/8095; B67D 3/0009; B67D 3/0022; B67D 3/0038

USPC ..... 222/146.1

See application file for complete search history.

(56) References Cited

U.S. PATENT DOCUMENTS

2005/0172952 A1* 8/2005 Williams ..... B01D 1/0017 126/344

2008/0050105 A1* 2/2008 Yui ..... F24H 1/202 392/450

(Continued)

*Primary Examiner* — Jeremy W Carroll

(57) ABSTRACT

Bottom-loading bottled water dispensers are disclosed that include hot water sanitizing capabilities (and, optionally, UV light sanitizing features). The dispensers include a water bottle that is operably connected to a pump that is configured to extract water from the bottle and force the water through one or more tubes and into a cold tank. The cold tank includes an evaporator that is configured to chill the water in the cold tank. The dispensers further include a hot tank that is fluidly coupled to the cold tank through one or more tubes, with the hot tank being attached to a heating element that is configured to heat the water in the hot tank. In addition, the dispensers include an electronic control board that is configured to heat a volume of water contained in the cold tank above a defined threshold temperature and for a defined period of time that is effective to sanitize the internal surfaces of the cold tank.

15 Claims, 21 Drawing Sheets

(51) Int. Cl.
*B67D 1/08* (2006.01)
*B67D 1/12* (2006.01)

(56) References Cited

U.S. PATENT DOCUMENTS

2008/0247924 A1* 10/2008 Yui ..... A61L 2/04
422/307
2010/0005825 A1* 1/2010 Yui ..... B67D 3/0032
62/389
2010/0243683 A1* 9/2010 Yui ..... B67D 3/0058
222/505
2011/0120921 A1* 5/2011 Kim ..... B67D 1/0004
210/97
2011/0259913 A1* 10/2011 Yui ..... B67D 1/0004
222/66
2012/0074166 A1* 3/2012 Yui ..... B67D 1/07
222/67
2012/0189502 A1* 7/2012 Yui ..... B67D 1/0857
422/168
2015/0360924 A1* 12/2015 Orita ..... C02F 1/325
222/190
2016/0052769 A1* 2/2016 Orita ..... B67D 1/0004
222/108
2017/0190556 A9* 7/2017 Wang ..... B67D 1/07

* cited by examiner

BOTTOM-LOADING BOTTLED WATER DISPENSERS WITH HOT WATER SANITIZING FEATURES

CROSS-REFERENCE TO RELATED APPLICATIONS

This application is a continuation-in-part of patent application Ser. No. 14/751,081, filed Jun. 25, 2015, which is a non-provisional of, and claims priority to, U.S. provisional patent application Ser. No. 62/173,307, filed Jun. 9, 2015.

FIELD OF THE INVENTION

The field of the present invention relates to bottom-loading bottled water dispensers that include hot water sanitizing capabilities.

BACKGROUND OF THE INVENTION

Bottled water dispensers are routinely used in homes and businesses as a source of clean and refreshing drinking water. Such dispensers may exhibit various forms, with some dispensers being configured to dispense both chilled and hot water. Unfortunately, the portions of such dispensers that hold and dispense chilled water create a suitable environment for bacterial growth and contamination. Several methods have evolved over the years to combat bacterial growth in bottled water dispensers, which range from manual cleanings to the use of UV lamps and ozone. Unfortunately, such methods suffer from a number of drawbacks, such as being inefficient, labor intensive, expensive to implement, or they can present their own health risks.

In view of the foregoing, there is a continuing need for new and improved bottled water dispensers that provide an effective means for sanitizing the interior portions of the dispensers, and particularly those areas and surfaces that are most prone to bacterial growth and contamination. As the following will demonstrate, such needs and demands in the marketplace (along with others) are provided by the inventions described herein.

SUMMARY OF THE INVENTION

According to certain aspects of the present invention, bottled water dispensers are provided that include hot water sanitizing capabilities. More specifically, the bottled water dispensers of the present invention include a means for applying sanitizing hot water to the internal surfaces of the dispensers that are most prone to bacterial contamination. The dispensers of the present invention include a cabinet that houses a water bottle, which holds a defined volume of water and may be easily replaced when the water has been depleted.

The invention provides that the water bottle is operably connected to a pump that is configured to extract water from the bottle and force the water through one or more tubes and into a cold tank. The cold tank includes an evaporator that, along with an operably connected compressor, is configured to chill the water in the cold tank. The dispensers further include a hot tank that is fluidly coupled to the cold tank through one or more tubes, with the hot tank being attached to a heating element that is configured to heat the water that is contained within the hot tank. The dispensers include a first external faucet that is fluidly coupled to the cold tank (for dispensing cold water) and a second external faucet that is fluidly coupled to the hot tank (for dispensing hot water).

In addition, the dispensers of the present invention include an electronic control board that is configured to cause the volume of water contained in the cold tank to be heated above a defined threshold temperature and for a defined period of time that is effective to sanitize the internal surfaces of the cold tank. Still further, the invention provides that a UV lamp may, optionally, be positioned in-line between the pump (which extracts water from the water bottle) and the cold tank, in order to expose the water to sanitizing UV radiation, which provides a second means for sanitizing the water prior to its delivery to the cold tank. In addition, in certain embodiments, the dispensers of the present invention may, optionally, include an ozone generator and an ozone tube, which are configured to deliver sterilizing ozone gas to the cold tank at the direction of the electronic control board (which provides yet another means for sanitizing the water included in the cold tank).

The invention provides that the electronic control board may heat the volume of water contained in the cold tank by causing hot water to flow from the hot tank and into the cold tank, e.g., through a dedicated tube and solenoid valve that may be open and closed by the electronic control board. Alternatively, the invention provides that the electronic control board may heat the volume of water contained in the cold tank by activating a heating element contained within the cold tank. Still further, the invention provides that a circulating water pump may be employed to force water from the hot tank to enter and mix with the water contained in the cold tank during a sanitization procedure. The invention provides that certain components of the invention may exhibit different configurations. For example, the evaporator may be located outside or within the cold tank. Likewise, as mentioned above, the water contained in the cold tank may be heated through the transfer of water from the hot tank or, alternatively, through the activation of a heating element that is located within the cold tank.

The above-mentioned and additional features of the present invention are further illustrated in the Detailed Description contained herein.

DETAILED DESCRIPTION OF THE INVENTION

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

Figure 1:
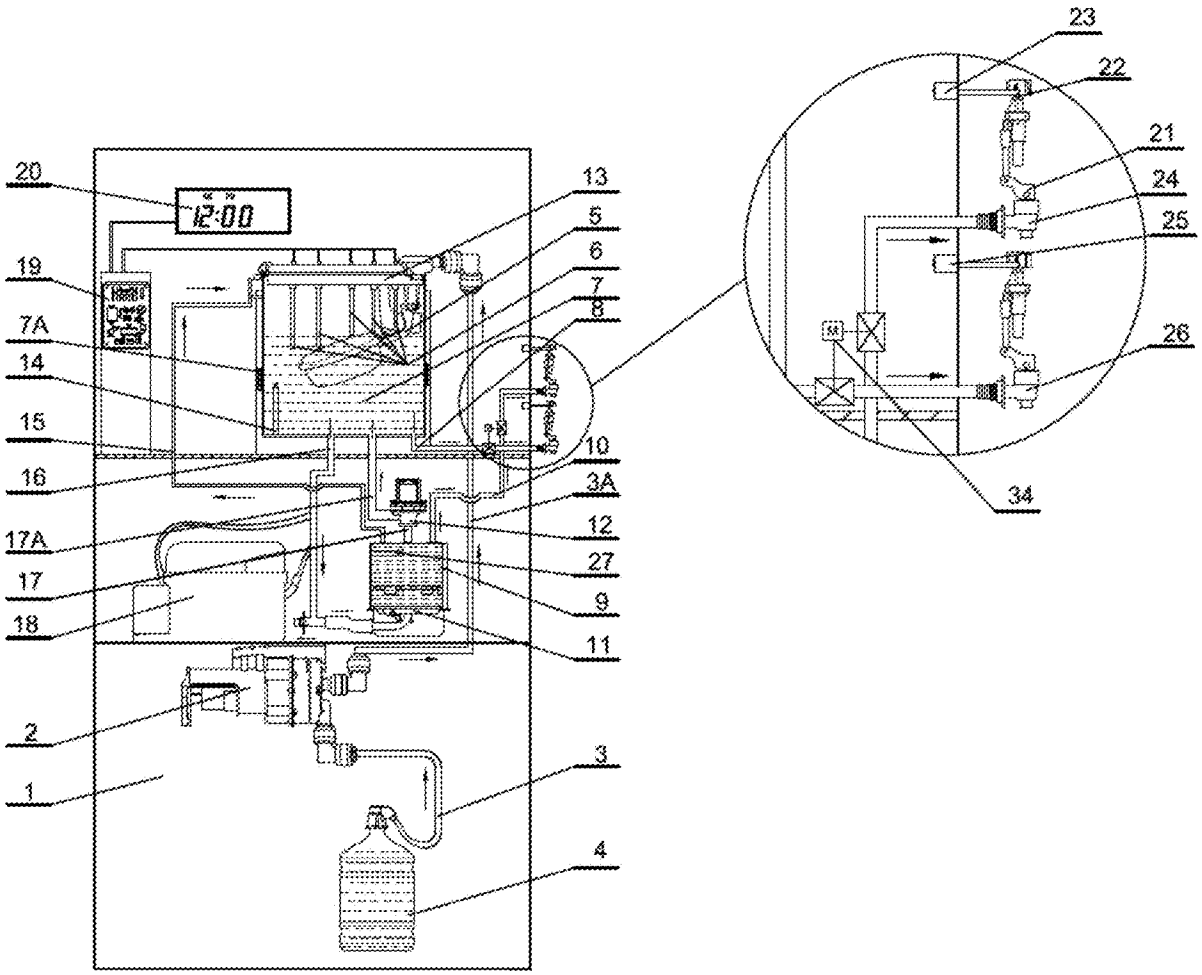
FIG. 1 is a diagram of a first embodiment of the bottled water dispensers of the present invention.

Referring now to FIG. 1, the bottled water dispensers of the present invention generally include a cabinet (1) that houses a bottle of water (4) that rests on or near the floor of the cabinet (1). The bottle of water (4) is connected to a pump (2), which is configured to force water out of the bottle (4) and through a set of tubes (3) and (3A). The invention provides that tube (3A) is responsible for delivering water to a cold water tank (7). The cold water tank (7) is equipped with a series of electronic water level sensors (6) and, optionally, a mechanical float valve (5) suspended from the lid (13) of the cold water tank (7). The electronic water level sensors (6) and, optionally, the mechanical float valve (5) are configured to detect and continuously monitor the water level in the cold water tank (7), which information is reported to an electronic control board (19) of the dispenser. In certain embodiments, instead of electronic water level sensors (6) being used for such purpose, a reed switch or a floating electromagnetic switch may be employed. The cold water tank (7) is also equipped with an evaporator (7A), which wraps around the exterior of the cold water tank (7) and, together with an operably connected compressor (18), is configured to chill the water contained within the cold water tank (7). The cold water tank (7) preferably includes a temperature sensor (14) located within the interior of the cold water tank (7), which is configured to detect and continuously monitor the temperature of the water contained in the cold water tank (7), which information is also reported to the electronic control board (19) of the dispenser.

The bottled water dispensers of the present invention include another tube (16) that is configured to funnel water from the cold water tank (7) to a hot water tank (9), which is located below the cold water tank (7). The invention provides that the hot water tank (9) is equipped with a bottom-mounted electrical heater (11), which is configured to heat the water contained within the hot water tank (9). In other embodiments, alternative heating elements may be employed, such as external band heaters wrapped around the hot water tank (9) or a heating tube (through which water passes to heat the water).

The invention provides that the dispenser includes another set of tubes (17) and (17A), with a solenoid valve (12) located between such tubes (17) and (17A), which are configured to deliver hot water (from the hot water tank (9)) back to the cold water tank (7) during a sanitization procedure, as described further below. The invention provides that another tube (15) connects a top portion of the hot water tank (9) to the top portion of the cold water tank (7). Still further, another tube (10) is operably and fluidly coupled to the hot tank (9), which is configured to extract and deliver hot water to a mechanically-operated external faucet (24). As described further below, the external faucet (24) is coupled to a solenoid valve (23), an actuator lever (21), and an actuator link (22).

During operation, the invention provides that pump (2) will be instructed by the electronic control board (19) to activate and force/extract water from the bottle (4), and deliver such water to the cold water tank (7) via tube (3), tube (3A), when the float valve (5) and the electronic water level sensors (6) determine that the water level has dipped below a defined threshold. Once the water level within the cold water tank (7) reaches the defined threshold, the electronic control board (19) is notified by the sensors (6), whereupon the electronic control board (19) instructs the pump (2) to deactivate and terminate the extraction of water from the bottle (4). Similarly, when the water temperature rises above a defined threshold, which is reported to the electronic control board (19) by the temperature sensor (14) located within the cold tank (7), the electronic control board (19) will instruct the compressor (18) to activate and begin chilling the water via the evaporator (7A) that wraps around the exterior of the cold water tank (7). Once the water temperature dips below the defined threshold, the electronic control board (19) will instruct the compressor (18) to deactivate. The invention provides that the electronic control board (19) is preferably coupled to a visual display (20), which a user of the dispenser may view to ascertain the then current water temperatures (and, optionally, make adjustments to the desirable temperature of the water included in the cold tank (7)).

The invention provides that water flows from the cold tank (7) through a tube (16) to the hot tank (9) by way of gravity force. The bottom-mounted electrical heater (11) is configured to heat the water contained within the hot tank (9). The hot tank (9) includes its own temperature sensor (27), which is configured to monitor and report the temperature of the water to the electronic control board (19). The electronic control board (19) will control the temperature of the water contained in the hot tank (9) by instructing the heater (11) to activate or deactivate, as necessary, to maintain the water temperature above a defined threshold (or within a defined range). The invention provides that hot water may be dispensed from the hot tank (9) through a tube (10) and a dedicated external faucet (24), whereby water is caused to exit the hot tank (9) through the faucet (24) by way of hydrostatic pressure.

According to certain preferred embodiments, the water dispensers of the present invention are configured to sanitize the interior portions of the dispensers, and particularly those areas and surfaces that are most prone to bacterial growth and contamination, using hot water. As used herein, the term "sanitize" means to kill a certain portion of bacteria that may be located on an internal surface of the dispenser, such as the internal surfaces of the cold tank (7). The invention provides that the protocol followed to perform the sanitization procedure may be controlled by a user through the external display (20), which will be saved and implemented by the electronic control board (19). The protocol may specify the frequency, duration, and timing of each sanitization procedure, as well as the temperature settings employed for the procedure.

At the commencement of a sanitization cycle, the electronic control board (19) will instruct the compressor (18) to deactivate (while the bottom-mounted electrical heater (11) is instructed to activate). Next, solenoid valve (12) is instructed to convert to an open position, such that cold water in the cold tank (7) and hot water in the hot tank (9) are allowed to mix. The invention provides that the temperature sensor (14) in the cold tank (7) will monitor and report the increase in temperature to the electronic control board (19), which will continue the sanitization cycle until the water temperature of the cold tank (7) reaches and stays above a defined threshold for a defined period of time. At the conclusion of the sanitization cycle, the electronic control board (19) will instruct solenoid valve (12) to convert to a closed position, and compressor (18) will be instructed to activate to begin chilling the water contained in the cold tank (7). As such, solenoid valve (12) is configured to open and close to allow for direct exchange of water (and convection exchange) between the cold tank (7) and hot tank (9). The invention provides that, as part of the programmed sanitization cycle, the electronic control board (19) may instruct the compressor (18) to activate (and deactivate) intermittently, so as to avoid overloading the compressor (18) when it begins to chill the water in the cold tank (7) following a sanitization cycle. In addition, the programmed sanitization cycle may also increase the frequency (and/or duration) of compressor (18) activations as the water in the cold tank (7) approaches the defined lower threshold, so as to expedite the chilling of the water once the temperature falls below the hot/sanitizing temperatures.

In certain preferred embodiments, during a sanitization cycle, the water temperature of the water in the cold tank (7) will reach between 70-degrees Celsius and 85-degrees Celsius, and will maintain such temperature for between 1 to 40 minutes. The parameters of a sanitization cycle may be tailored to the size of the water tanks (7),(9), compressor (18), and heater (11). In certain embodiments, the total sanitization cycle may take about 3 to 4 hours, which includes the sanitization step of heating the water in the cold tank (7) and subsequently chilling the water contained therein. As such, the electronic control board (19) may be pre-programmed, or programmed through the display (20), to execute a sanitization cycle during periods of non-use, such as around 2:00 a.m. (such that the cycle should be completed by the morning hours). In addition, the water dispenser may include a manually-operated control, e.g., within or in proximity of the display (20), which can be used to instruct the dispenser to perform the sanitization procedures described herein. For example, the manually-operated control may comprise a mechanical and/or electrical switch, which instructs the dispenser and electronic control board (19) to immediately execute the sanitization procedures described herein.

In addition, according to certain embodiments, the external faucets of the water dispenser may be equipped with certain safety features, which prevent a user from unknowingly dispensing sanitizing hot water from either water tank during a sanitization cycle. More specifically, each faucet (24),(26) may be operably coupled to a solenoid plunger valve (23),(25) that, when instructed by the electronic control board (19), will engage with an actuator of the faucet that prevents the faucet from being operated by a user to dispense water from the applicable tank. For example, each actuator may include a vertical arm (22) that may receive a plunger of the solenoid plunger valve (23), such that the vertical arm (22) is prevented from being depressed by a user, which would otherwise cause a connected arm (21) to pivot about a joint and cause the faucet (24) to open and water to exit therefrom. Following a sanitization cycle, once the water in the cold tank (7) has returned to room temperature or below, the electronic control board (19) will instruct the solenoid plunger valve (23),(25) to disengage, so that hot and cold water may then be dispensed from the faucets as described herein.

Figure 20:
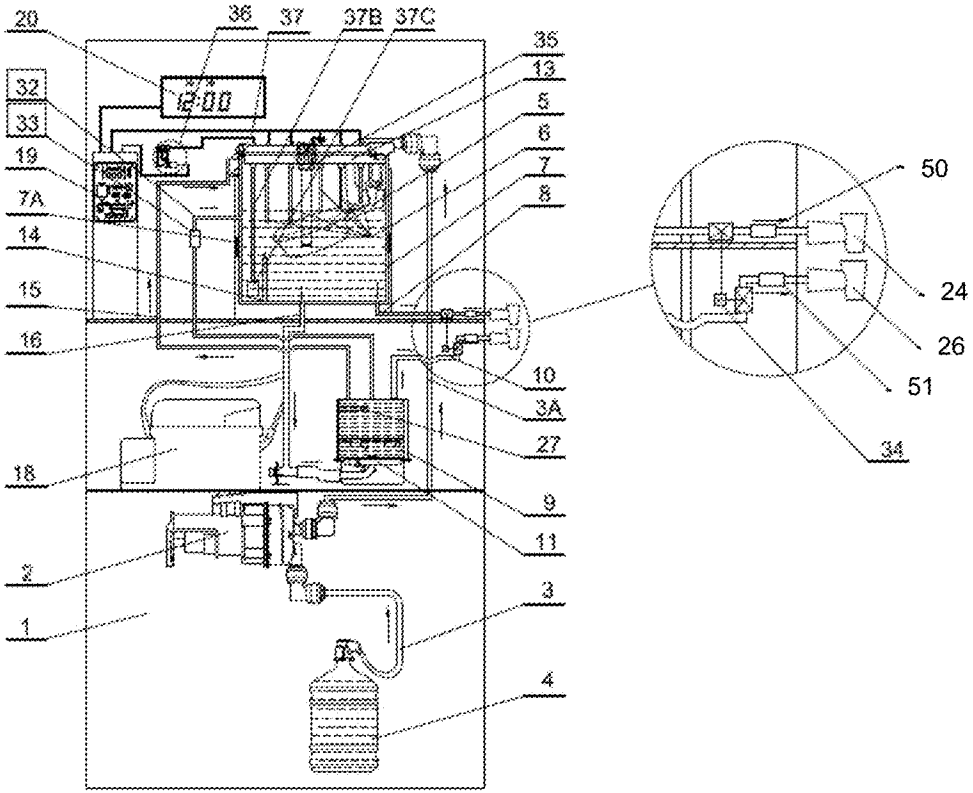
FIG. 20 is a diagram of another bottled water dispenser that includes a solenoid valve and an electronic control button, which can be operated to prevent the flow of water from the cold tank and out the external faucet during a hot water sanitization cycle.

In certain alternative embodiments, a set of solenoid water valves (34) may be employed to prevent the flow of water from each faucet (24),(26) during a sanitization cycle, whereby such solenoid valves (34) are in direct communication with the electronic control board (19). More particularly, and referring to FIG. 20, for example, a set of solenoid valves (34) may be positioned in-line (or integrally formed) with faucets (24),(26), along with a corresponding set of electronic control buttons (50),(51). In this embodiment, water may be dispensed from each faucet (24),(26) by pressing the applicable electronic control button (50),(51). In such embodiment, during a hot water sanitization cycle (and for the period of time following a hot water sanitization cycle during which the temperature of the water in the cold tank (7) is hot or above a defined threshold), the electronic control board (19) will disable the electronic control button (50),(51), and/or close the solenoid valves (34), such that hot water cannot be dispensed from the faucets (24),(26).

Figure 21:
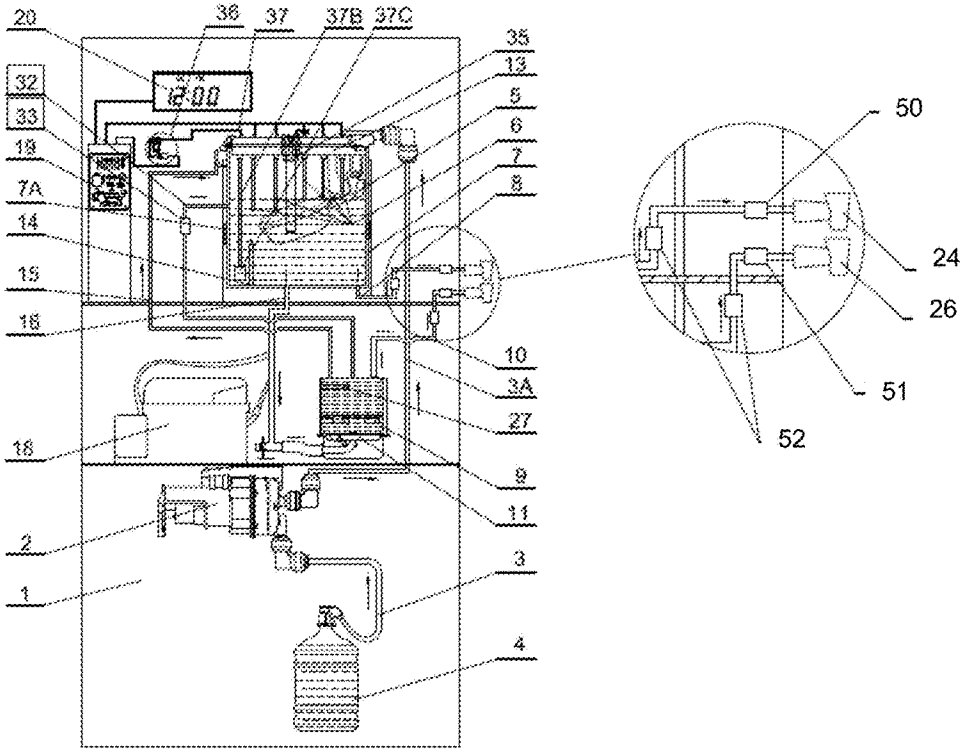
FIG. 21 is a diagram of another bottled water dispenser that includes a solenoid valve, an electronic control button, and a pump, which can be operated to prevent the flow of water from the cold tank and out the external faucet during a hot water sanitization cycle.

In yet another embodiment, and referring now to FIG. 21, the faucets (24),(26) are positioned in-line with a set of pumps (52), which are configured to force water from the cold tank (7) and out the faucets (24),(26), upon pressing the applicable electronic control button (50),(51). This embodiment is particularly useful when the water level in the cold tank (7) is below the faucets (24),(26), such that gravity force alone cannot be used to cause water to exit the dispenser. In this embodiment, during a hot water sanitization cycle (and for the period of time following a hot water sanitization cycle during which the temperature of the water in the cold tank (7) is too hot), the electronic control board (19) will disable the electronic control buttons (50),(51) and/or the set of pumps (52), such that hot water cannot be dispensed from the faucets (24),(26).

Figure 2:
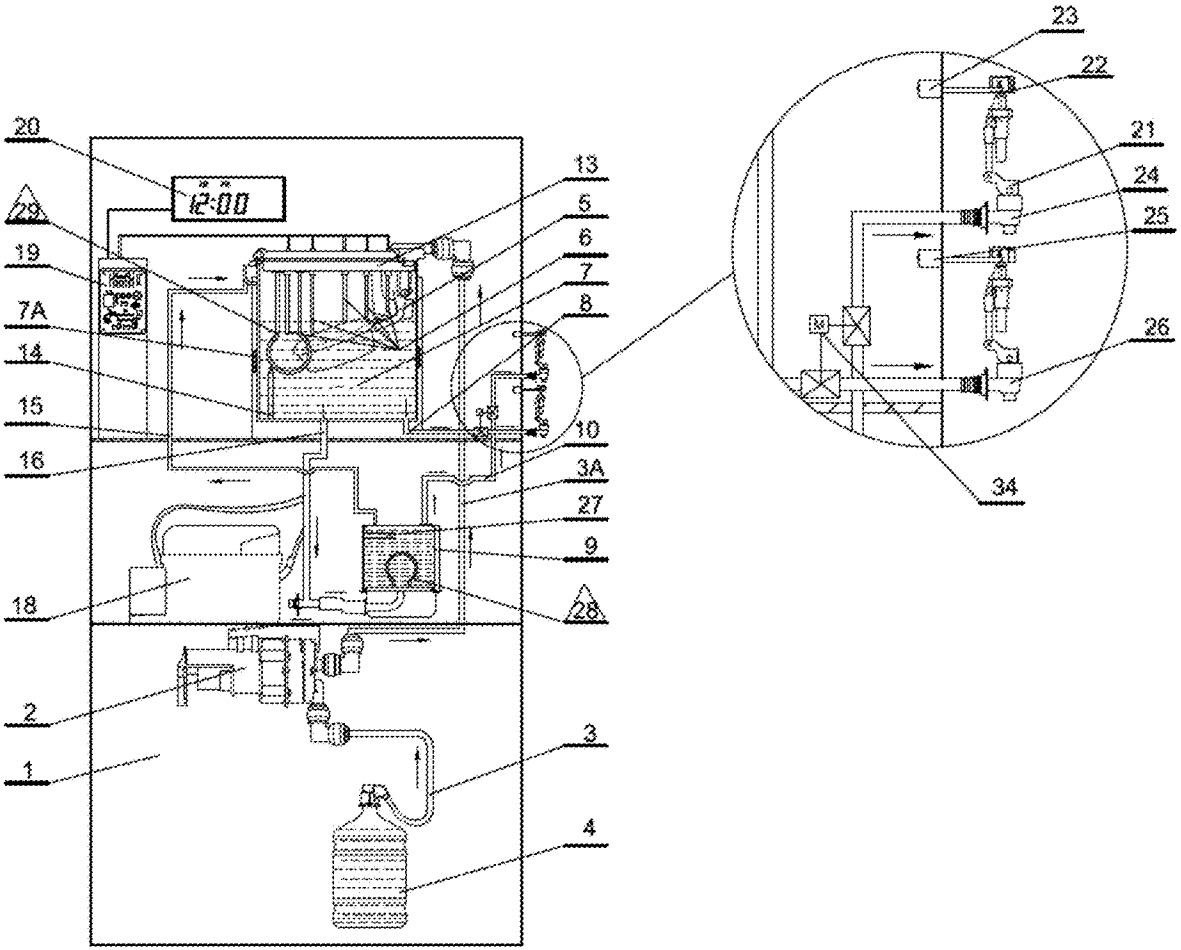
FIG. 2 is a diagram of a second embodiment of the bottled water dispensers of the present invention, which includes separate heating elements disposed with the interior of the cold tank and the hot tank.

The invention provides that the heating elements, evaporators, and other components of the bottled water dispensers may be configured in various ways. For example, and referring now to FIG. 2, in certain alternative embodiments, the bottled water dispensers of the present invention include a heating element (29) disposed within the cold tank (7), which may be attached and suspended from the lid (13) of the cold tank (7). The heating element (29) may be activated by the electronic control board (19) during a sanitization cycle to directly heat the water contained therein to the programmed sanitization temperature. In this embodiment, the heating element (29) may be used to heat the water in the cold tank (7) during sanitization procedures, instead of using hot water from the hot tank (9) for such purposes. Similarly, in such embodiments, the hot tank (9) may includes its own heating element (28) disposed within the hot tank (9), which may be attached to the floor of the hot tank (9) and used to heat the water contained therein.

Figure 3:
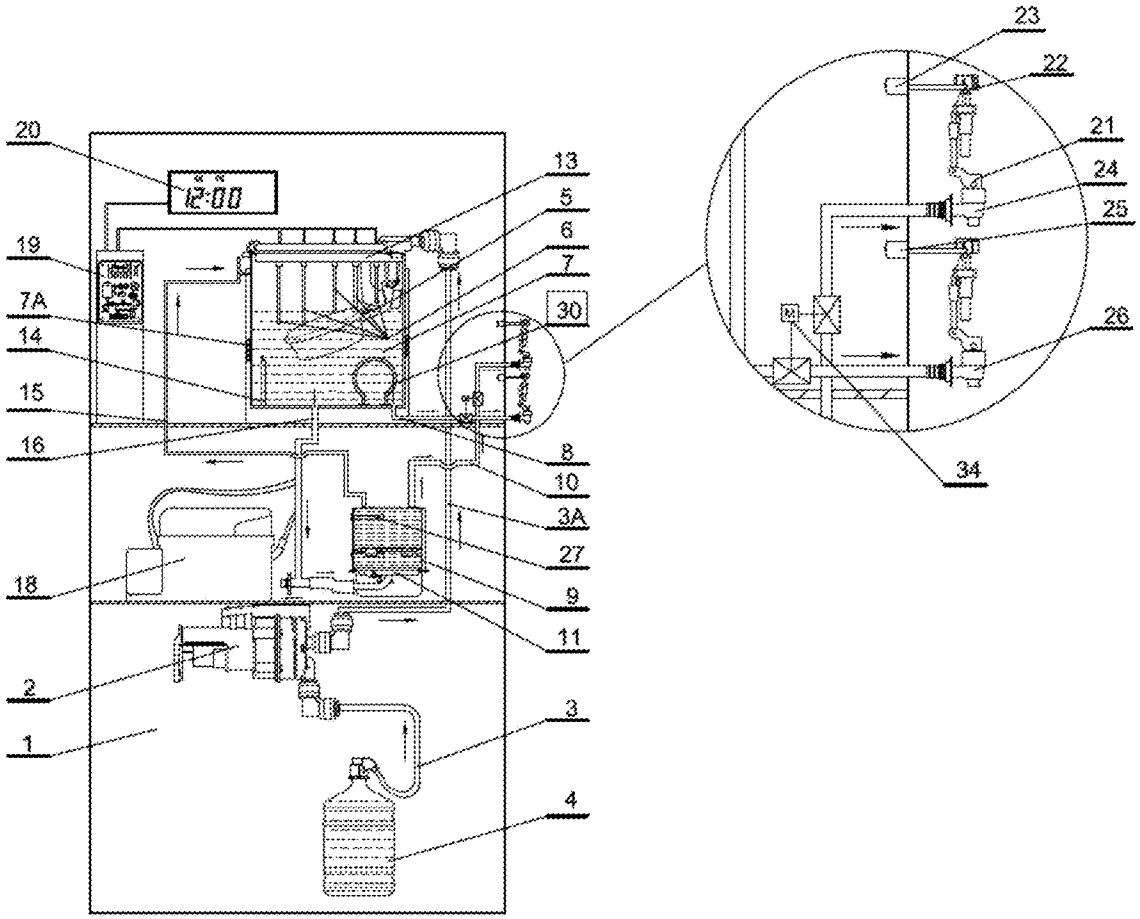
FIG. 3 is a diagram of a third embodiment of the bottled water dispensers of the present invention, which includes a separate heating element disposed in and attached to the floor of the hot tank.
Figure 4:
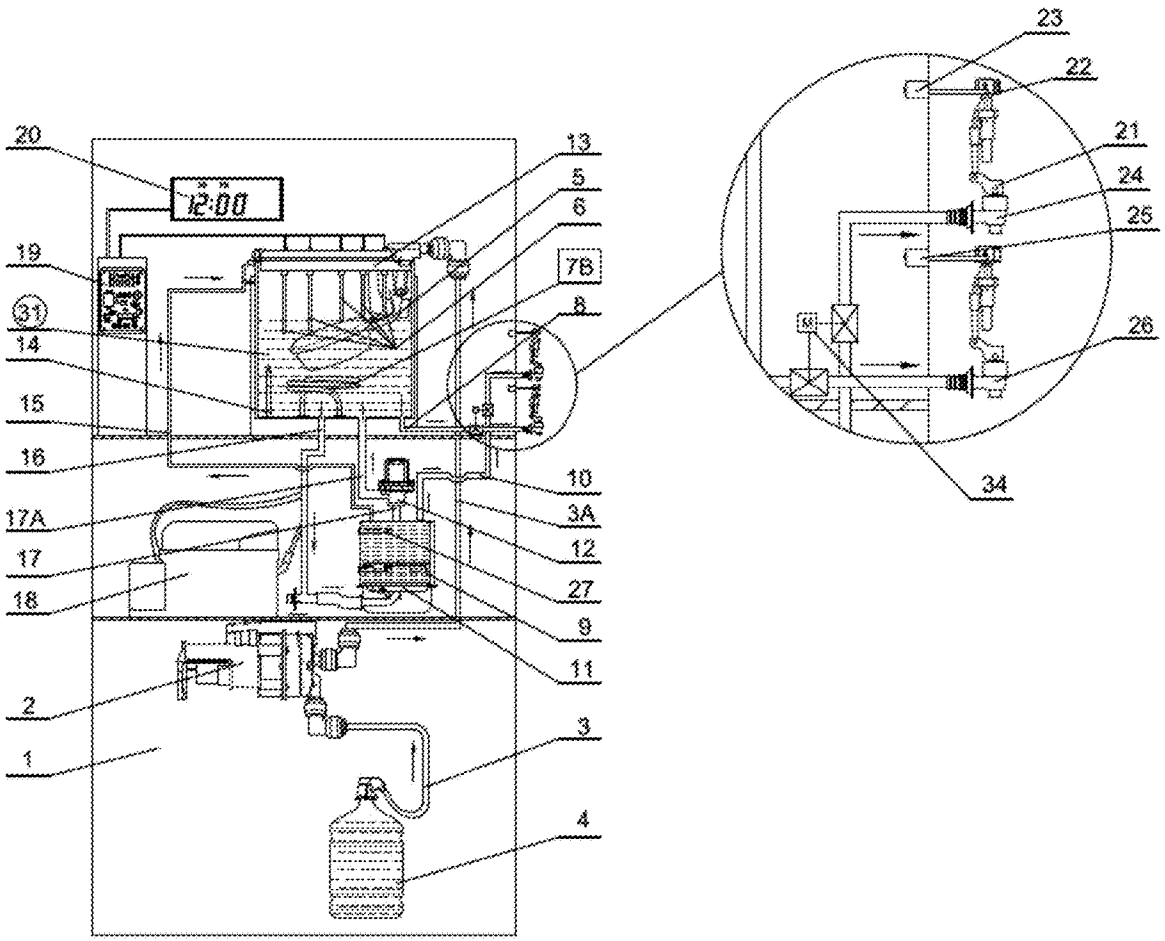
FIG. 4 is a diagram of a fourth embodiment of the bottled water dispensers of the present invention, which includes an internal evaporator disposed within the interior of the cold tank.
Figure 5:
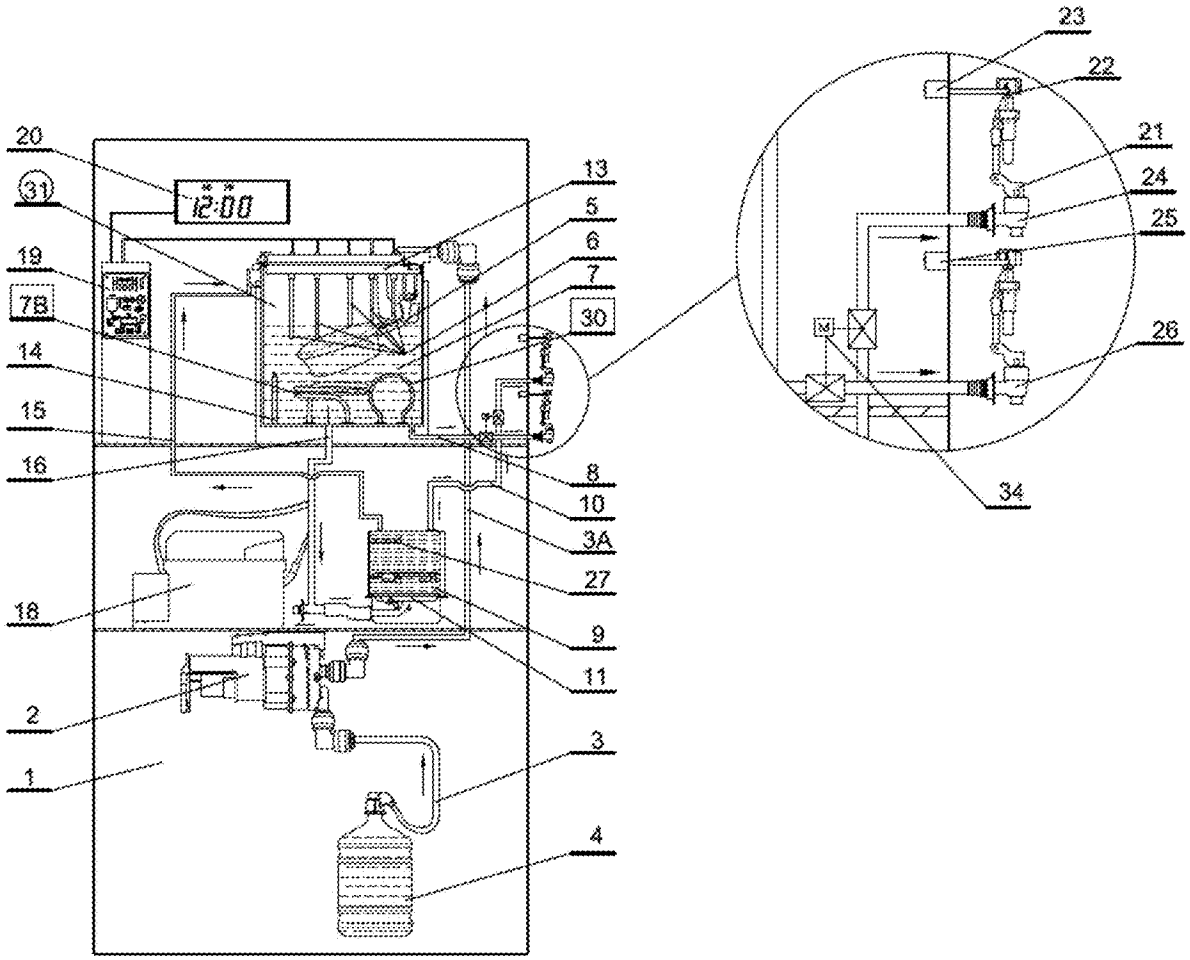
FIG. 5 is a diagram of a fifth embodiment of the bottled water dispensers of the present invention, which includes a heating element disposed within and attached to the floor of the cold tank, along with an internal evaporator that may be operated to chill the water contained therein.
Figure 6:
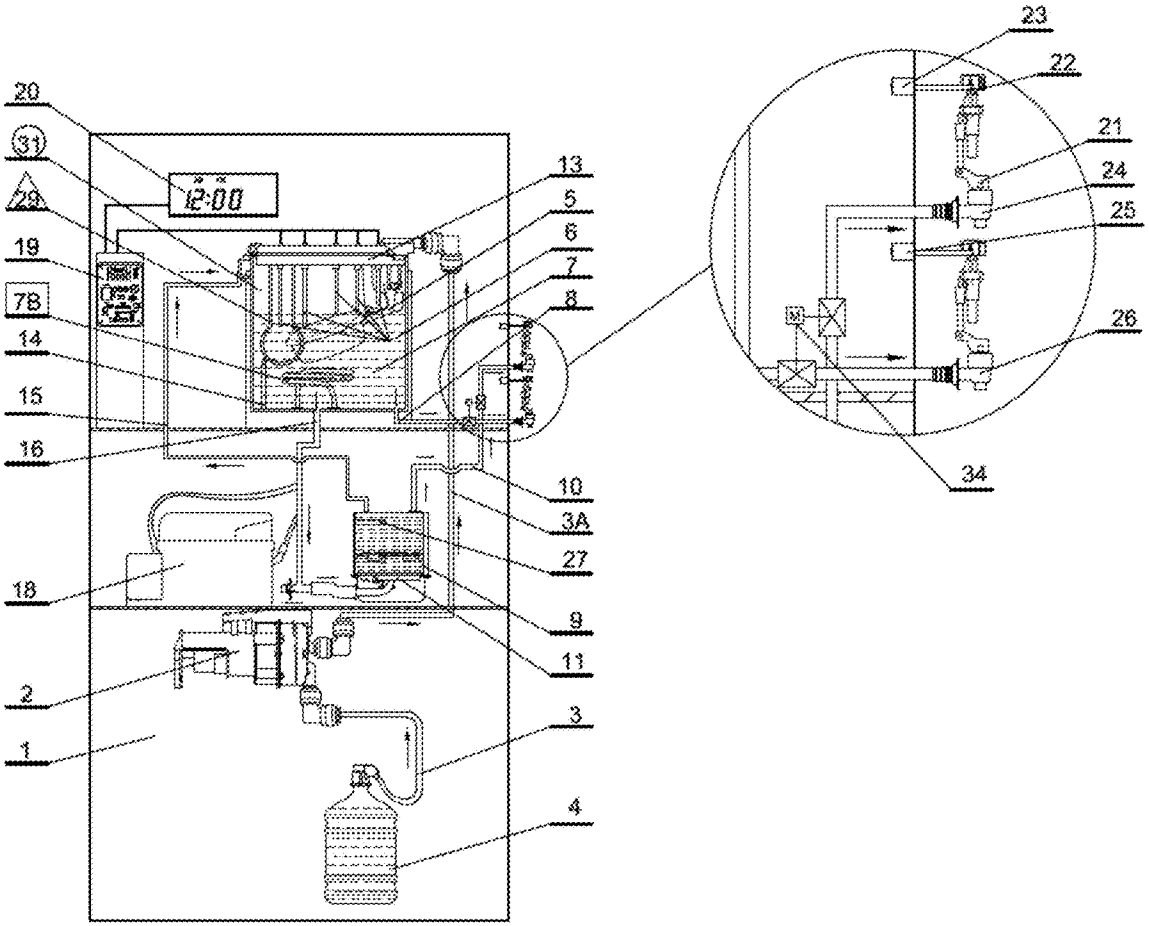
FIG. 6 is a diagram of a sixth embodiment of the bottled water dispensers of the present invention, which includes a heating element attached to and suspended from the lid of the cold tank, along with an internal evaporator that may be operated to chill the water contained therein.

Referring now to FIG. 3, in certain related embodiments, a heating element (30) disposed within the cold tank (7) may be attached to the floor of the cold tank (7). In other embodiments, as illustrated in FIG. 4, the cold tank (7) may include an internal evaporator (7B) that may be operated to chill the water contained therein, similar to the evaporator (7A) described above. According to still further embodiments, as illustrated in FIG. 5, the bottled water dispensers of the present invention may include a heating element (30) disposed within and attached to the floor of the cold tank (7), which may further include an internal evaporator (7B) that may be operated to chill the water contained therein. Still further, as shown in FIG. 6, the bottled water dispensers of the present invention may include a heating element (29) attached to and suspended from the lid (13) of the cold tank (7), along with an internal evaporator (7B) that may be operated to chill the water contained therein.

Figure 7:
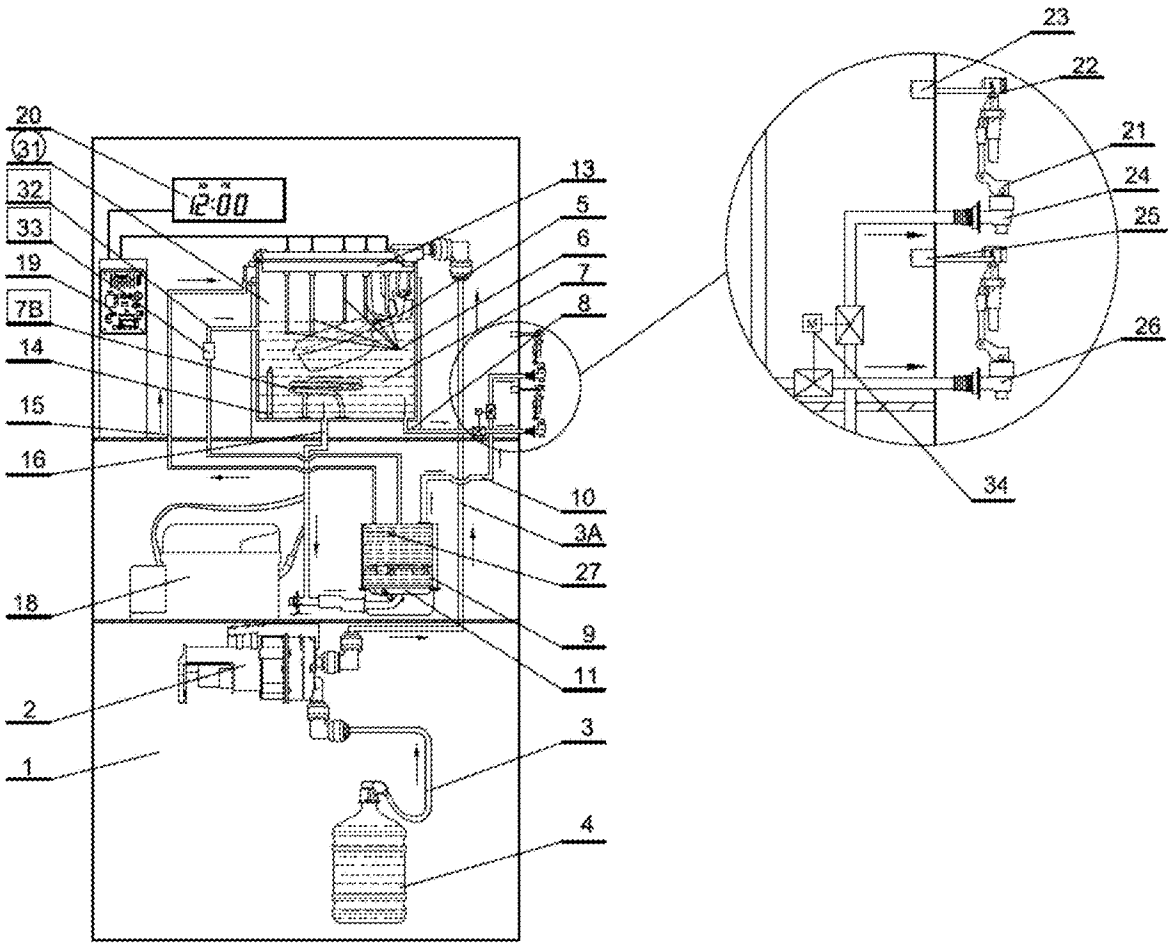
FIG. 7 is a diagram of a seventh embodiment of the bottled water dispensers of the present invention, which includes a water pump that is configured and operated to cause cold water in the cold tank to mix with the hot water of the hot tank.
Figure 8:
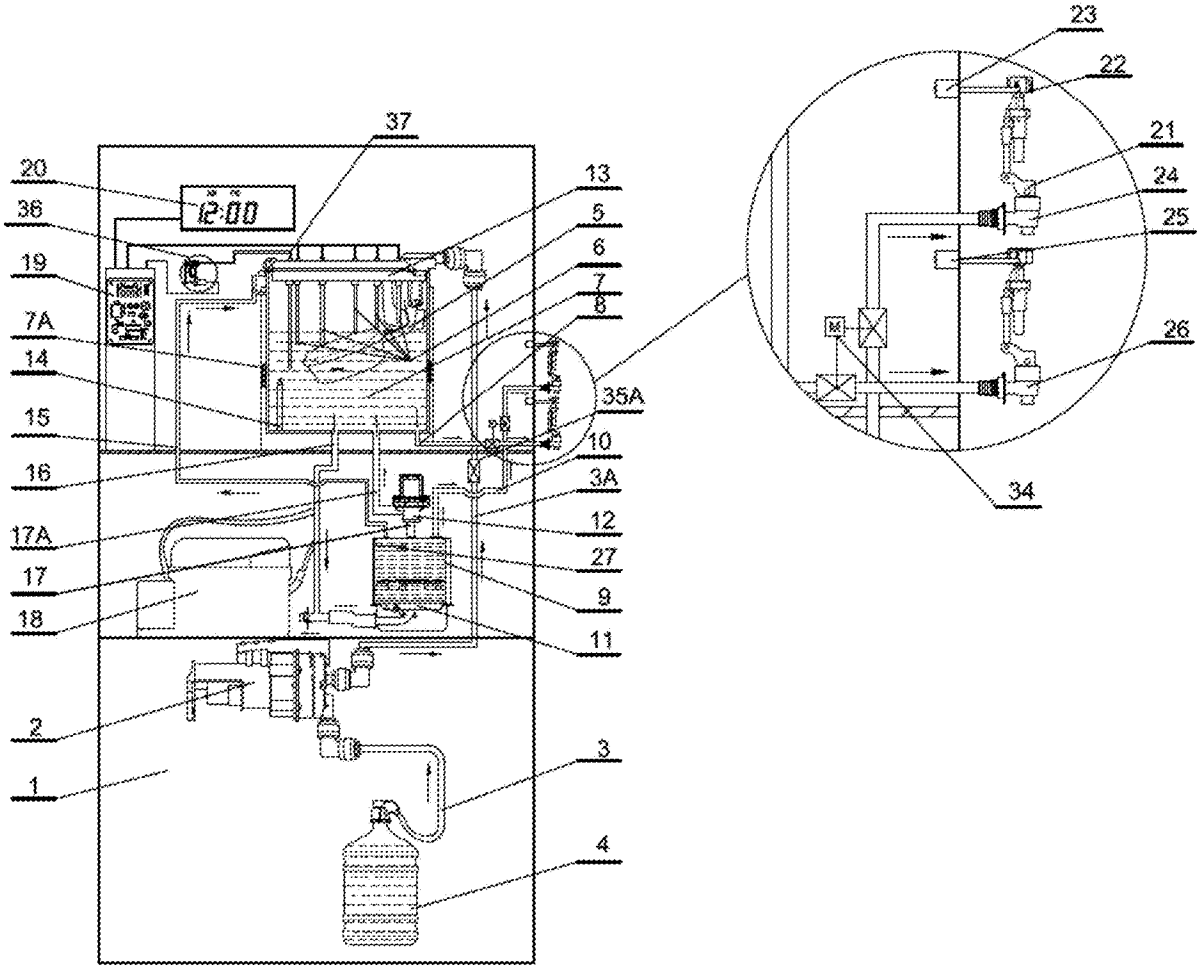
FIG. 8 is a diagram of the bottled water dispenser of FIG. 1, which further includes a UV lamp positioned in-line between the water pump and cold tank.
Figure 9:
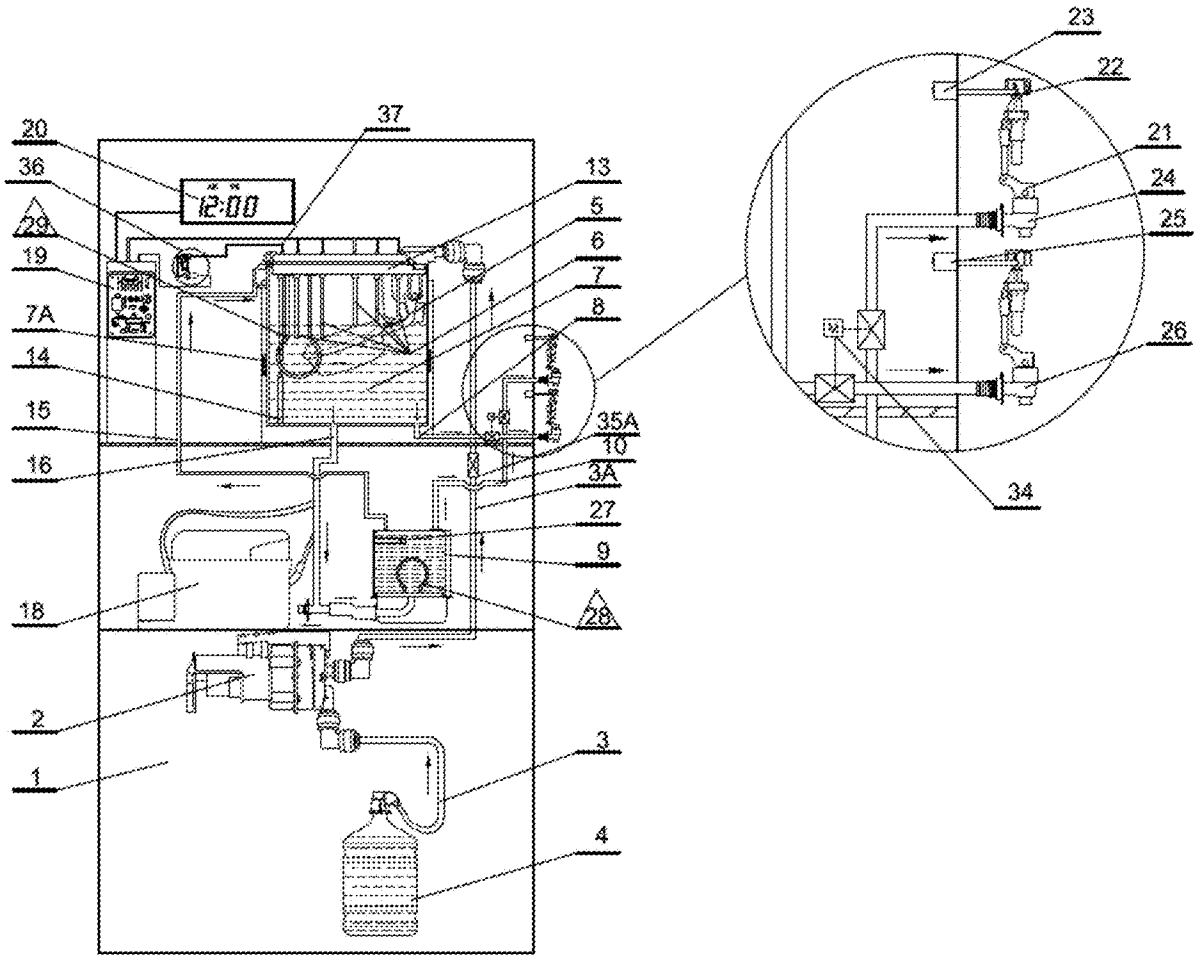
FIG. 9 is a diagram of the bottled water dispenser of FIG. 2, which further includes a UV lamp positioned in-line between the water pump and cold tank.
Figure 10:
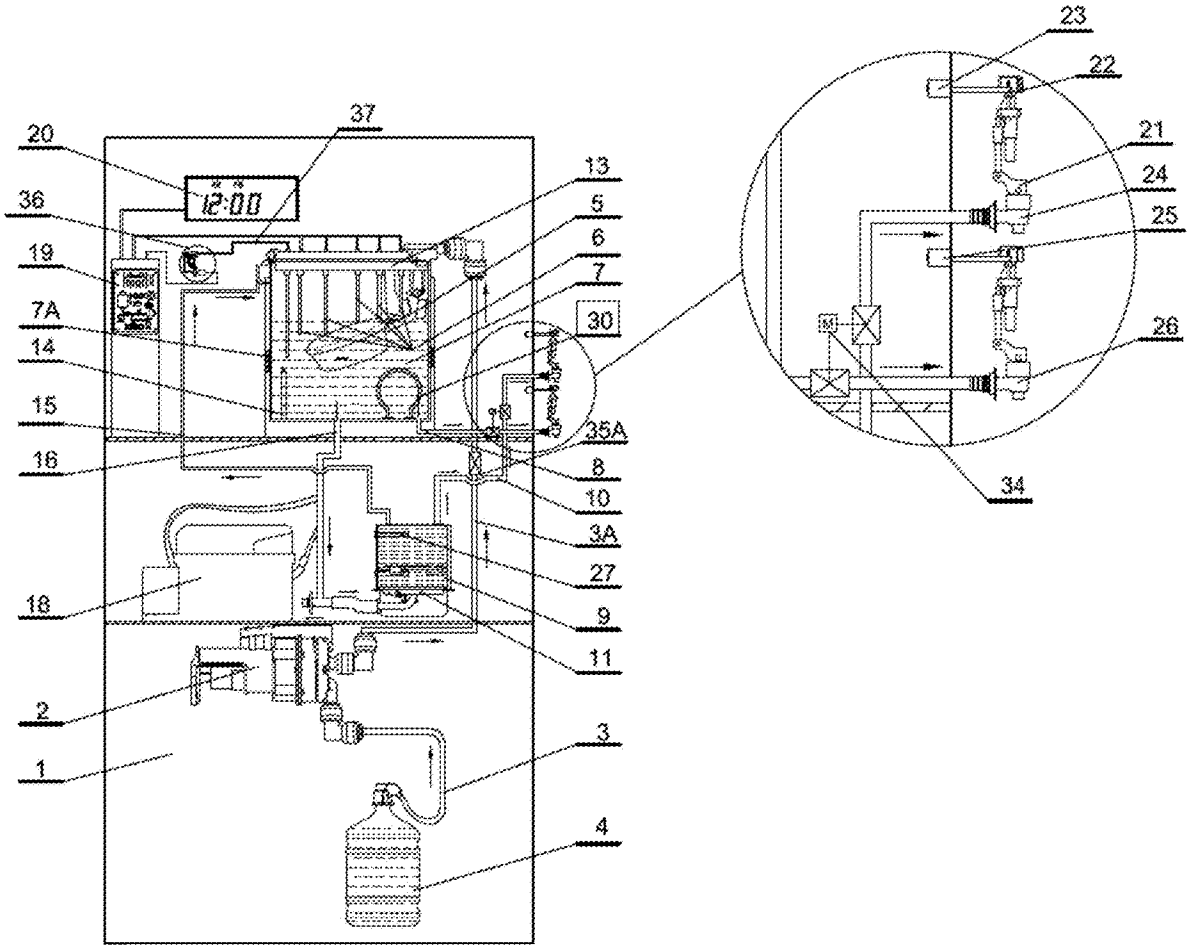
FIG. 10 is a diagram of the bottled water dispenser of FIG. 3, which further includes a UV lamp positioned in-line between the water pump and cold tank.
Figure 11:
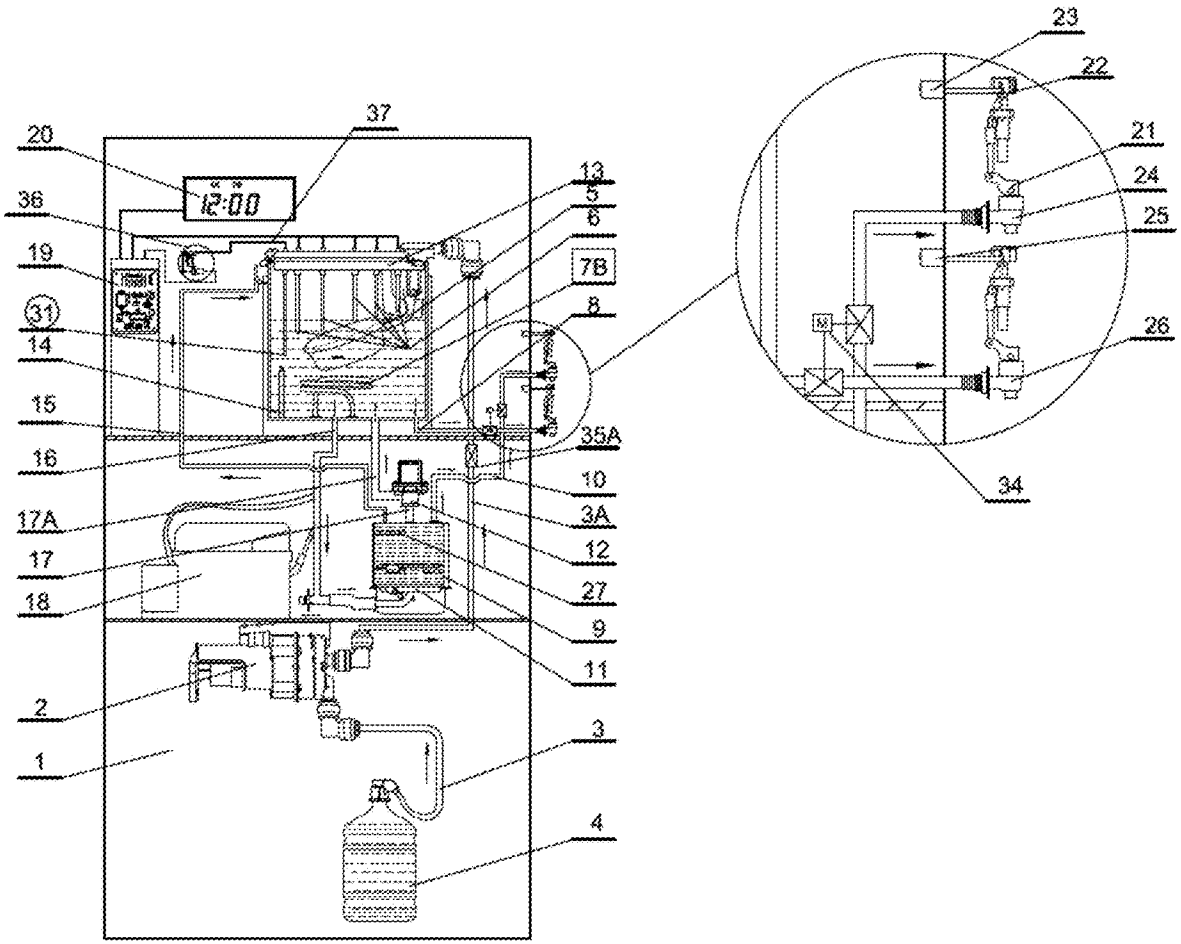
FIG. 11 is a diagram of the bottled water dispenser of FIG. 4, which further includes a UV lamp positioned in-line between the water pump and cold tank.
Figure 12:
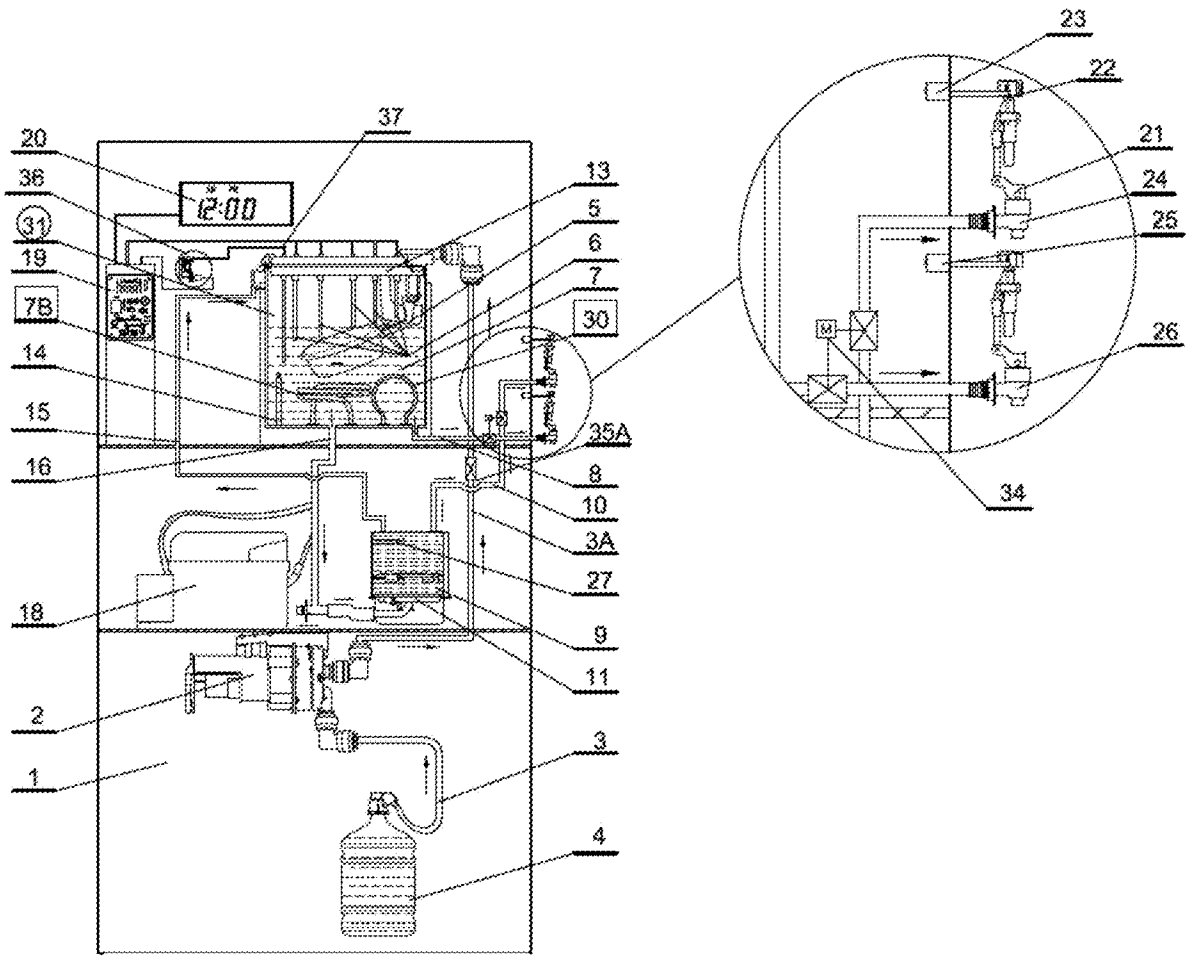
FIG. 12 is a diagram of the bottled water dispenser of FIG. 5, which further includes a UV lamp positioned in-line between the water pump and cold tank.
Figure 13:
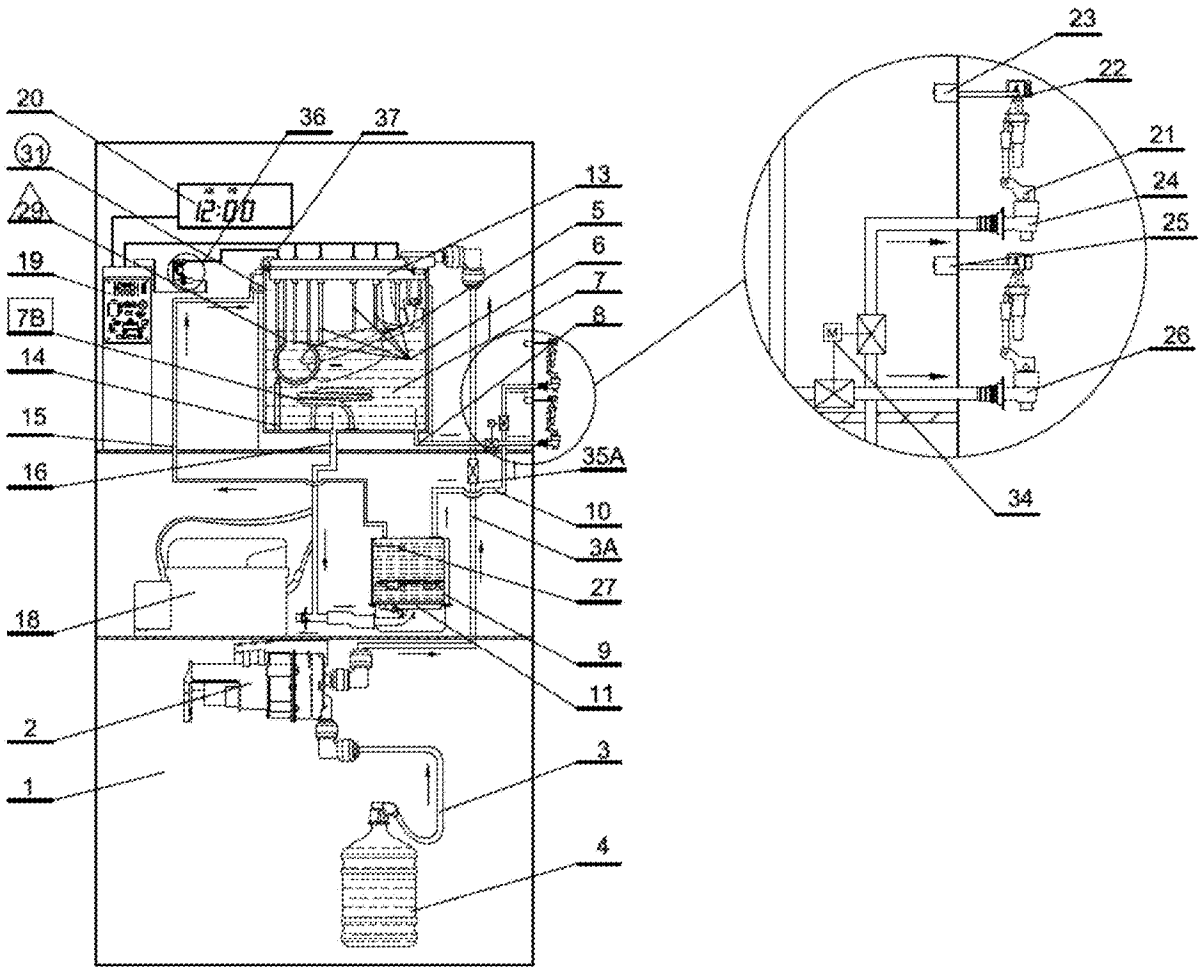
FIG. 13 is a diagram of the bottled water dispenser of FIG. 6, which further includes a UV lamp positioned in-line between the water pump and cold tank.
Figure 14:
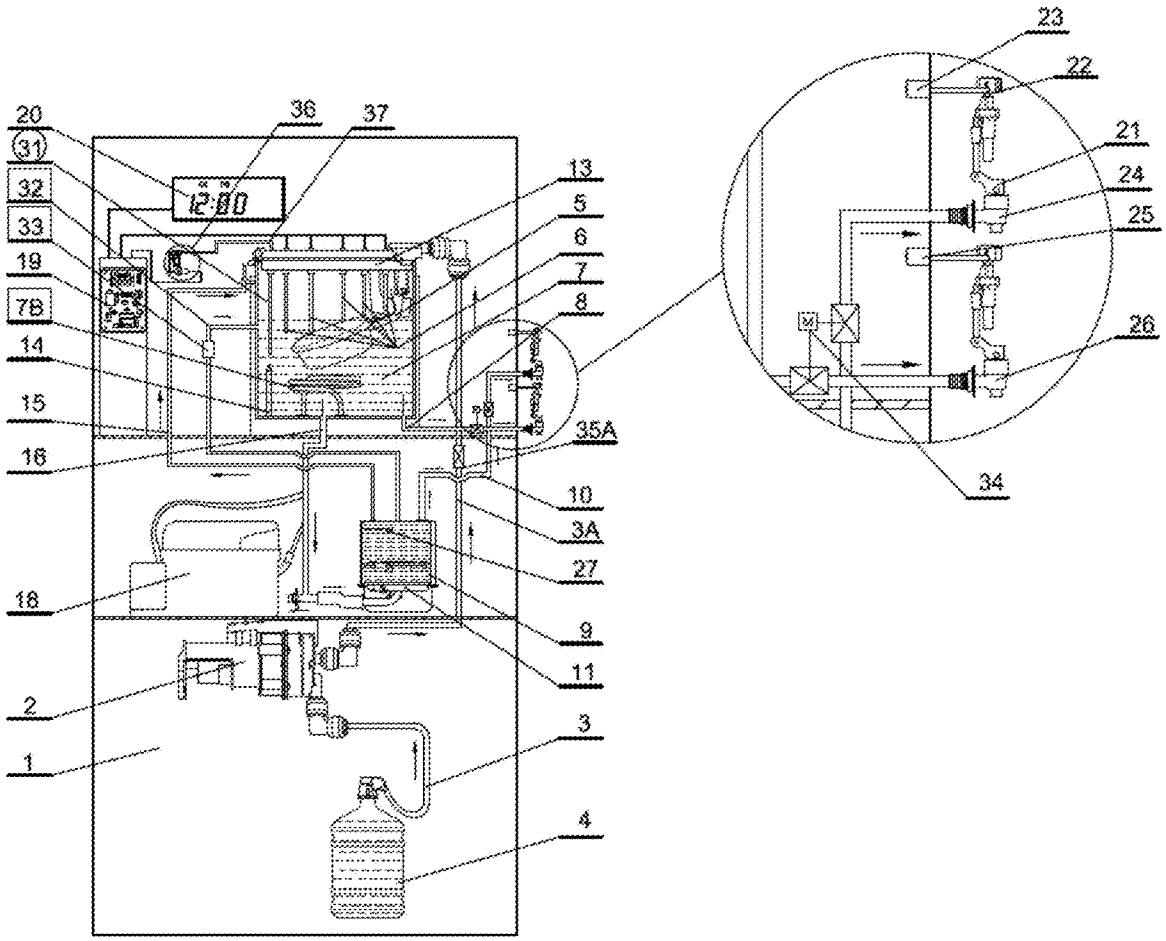
FIG. 14 is a diagram of the bottled water dispenser of FIG. 7, which further includes a UV lamp positioned in-line between the water pump and cold tank.

According to yet further embodiments, and referring now to FIG. 7, the bottled water dispensers of the present invention may include a recirculating water pump (33) that is configured and operated to force cold water in the cold tank (7) to mix with the hot water of the hot tank (9). In other words, in such embodiments, the pump (33) provides a force that is imparted (at the instruction of the electronic control board (19) during a sanitization cycle) to force water to travel from one tank (e.g., the hot tank (9)) to another (e.g., the cold tank (7)) via a dedicated tube (32), instead of such mixing occurring by way of convection forces.

Referring now to FIGS. 8-14, in certain embodiments, the invention provides that the water dispensers may further comprise an ultraviolet (UV) lamp (35A) that is positioned in-line, i.e., contiguously connected to water line/tube (3A)) between the pump (2), which extracts water from the water bottle (4), and the cold tank (7). The UV lamp (35A) is configured to expose the water—which runs through tube (3A)—to sanitizing UV radiation, which provides a second means for sanitizing the water (prior to its delivery to the cold tank (7)). The invention provides that activation, deactivation, and control of the UV lamp (35A) is preferably managed by the electronic control board (19). In certain embodiments, the electronic control board (19) activates the UV lamp (35A) only during the passage of water through tube (3A) from the water bottle (4) to the cold tank (7)—and is deactivated when water is not passing through tube (3A).

Referring now to FIGS. 15-19, according to yet further embodiments, the invention provides that the water dispensers may comprise an ozone source/ozone generator (36). In certain embodiments, and referring to FIG. 15, the water dispensers may comprise a tube (37)/(37B) that is configured to deliver and deposit ozone gas from the ozone generator (36) and to the water contained in the cold tank (7), whereby tube (37B) terminates near the floor of the cold tank (7) and submerged within the water. The tube (37B) will include a diffuser (37C) through which the ozone gas will exit the tube (37B) and enter the water of the cold tank (7). In certain alternative embodiments, the invention provides that tube (37B) may terminate above the water level in the cold tank (7)—and deposit ozone gas directly into such space within the cold tank (7). The cold tank (7) will preferably further include a filter that is configured to sequester or destroy ozone gas, prior to it exiting into the ambient air. The filter may be comprised of block or granular activated carbon.

The invention provides that the electronic control board (19) is responsible for controlling the time(s) of day at which the ozone generator (36) is activated to provide the cold tank (7) with a defined amount of ozone gas. The invention provides that such time(s) may also be controlled through the user display (20). In addition, in these embodiments, the invention provides that an external source of water may be used (such as a tap water line), with the external water source being fluidly coupled to a container and one or more filters (49) housed within the dispenser, such that the tap water is filtered before entering the cold tank (7) via tube (3A). As with the other embodiments described herein, a UV lamp (35A) may optionally be positioned in-line with tube (3A), such that the filtered water is exposed to UV radiation prior to entering the cold tank (7).

Figure 15:
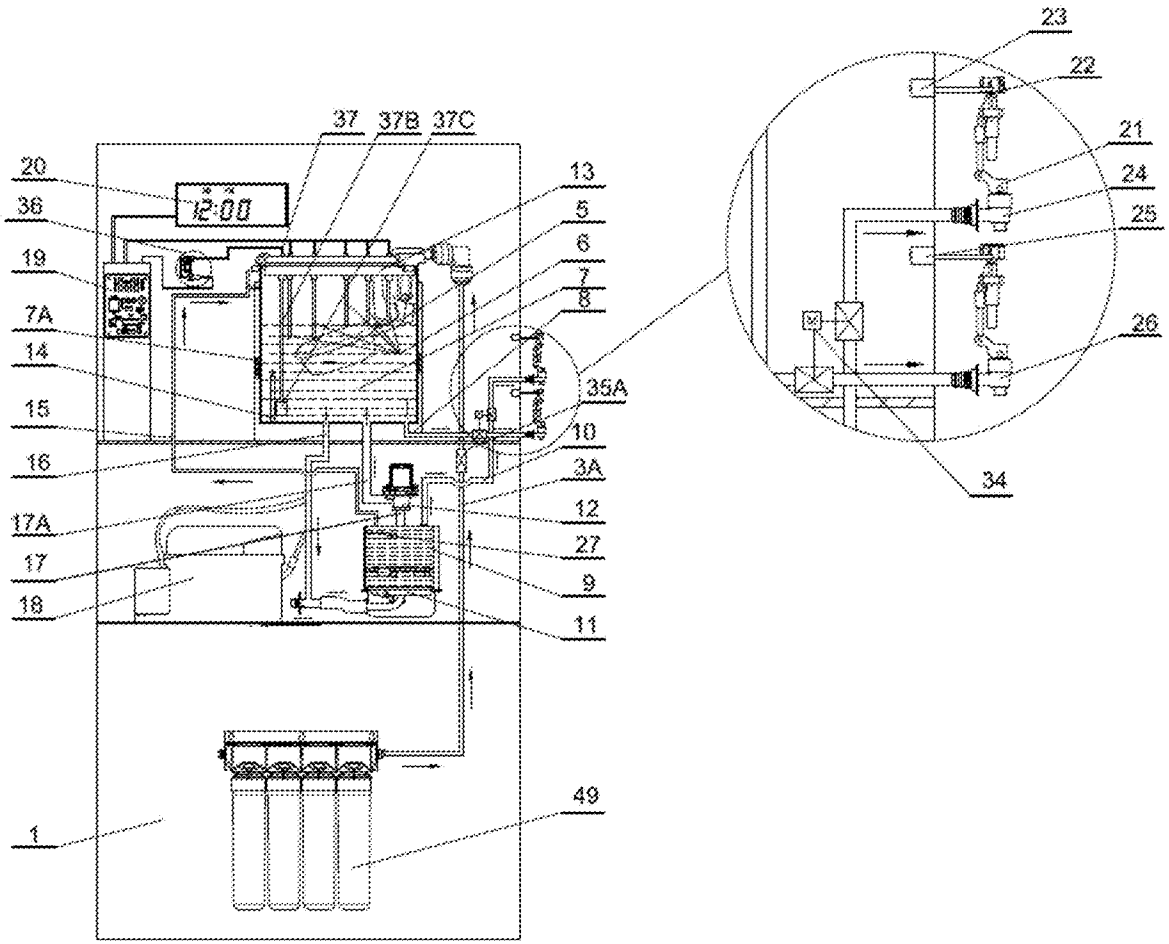
FIG. 15 is a diagram of a bottled water dispenser that includes an ozone generator and (optionally) a UV lamp, which also includes a solenoid valve in-line between the hot tank and cold tank to control mixing of water during a sanitization procedure.
Figure 16:
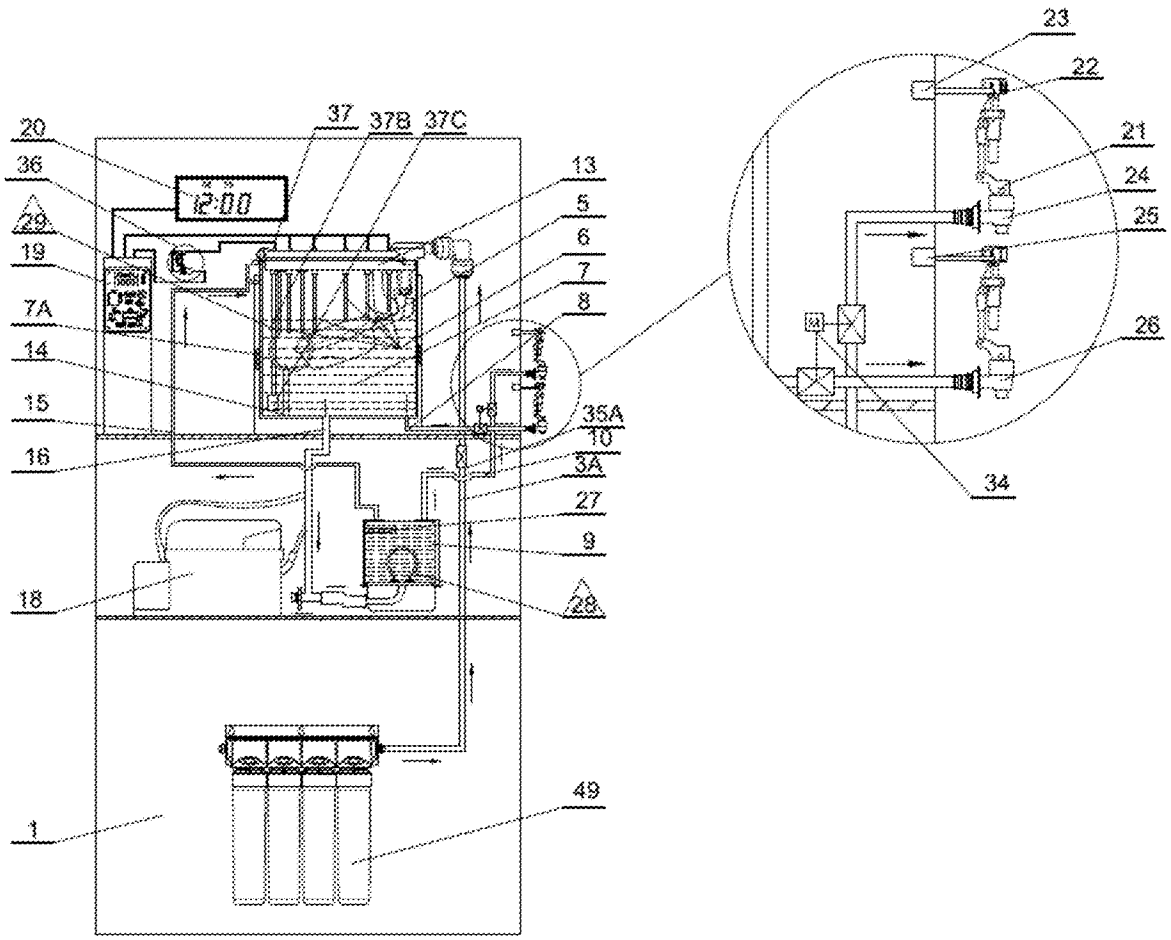
FIG. 16 is a diagram of another bottled water dispenser that includes an ozone generator and (optionally) a UV lamp, which includes a heating element suspended from the lid of the cold tank.
Figure 17:
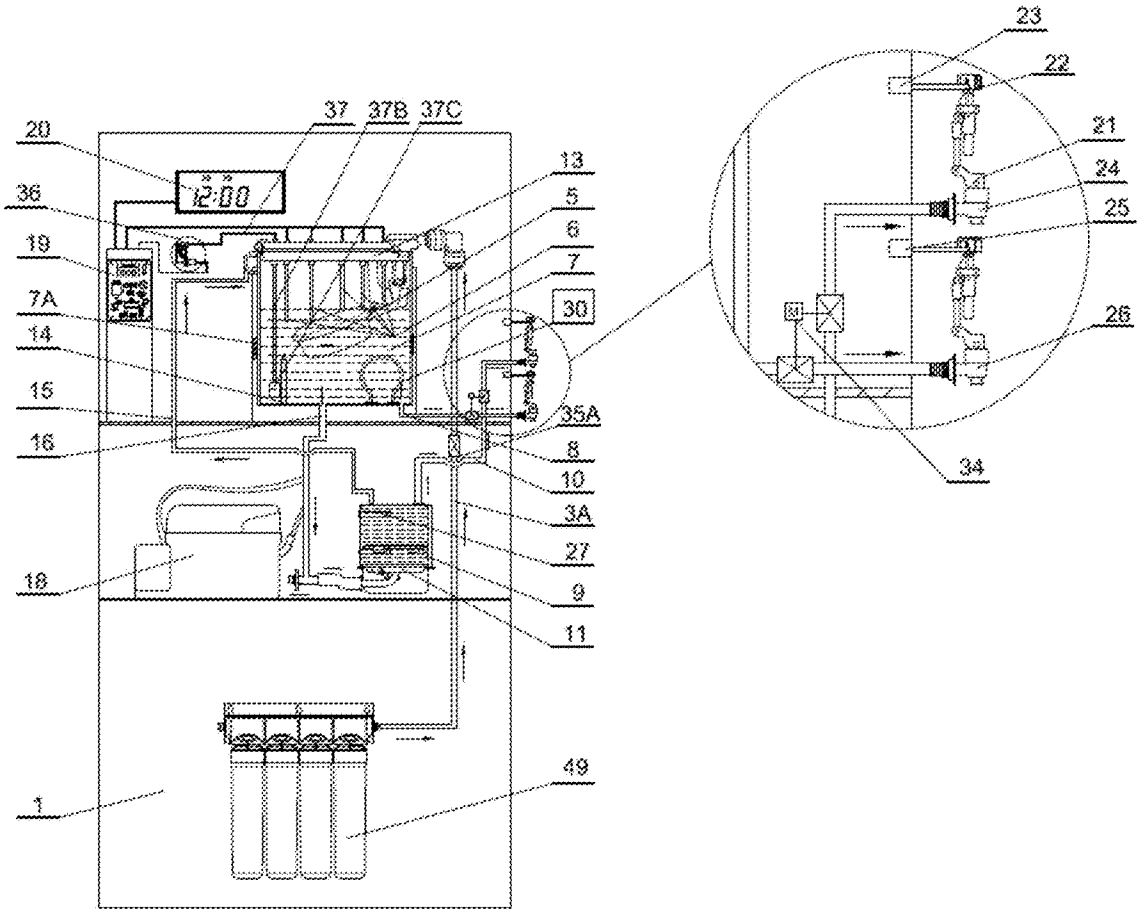
FIG. 17 is a diagram of another bottled water dispenser that includes an ozone generator and (optionally) a UV lamp, which includes a heating element attached to the floor of the cold tank.
Figure 18:
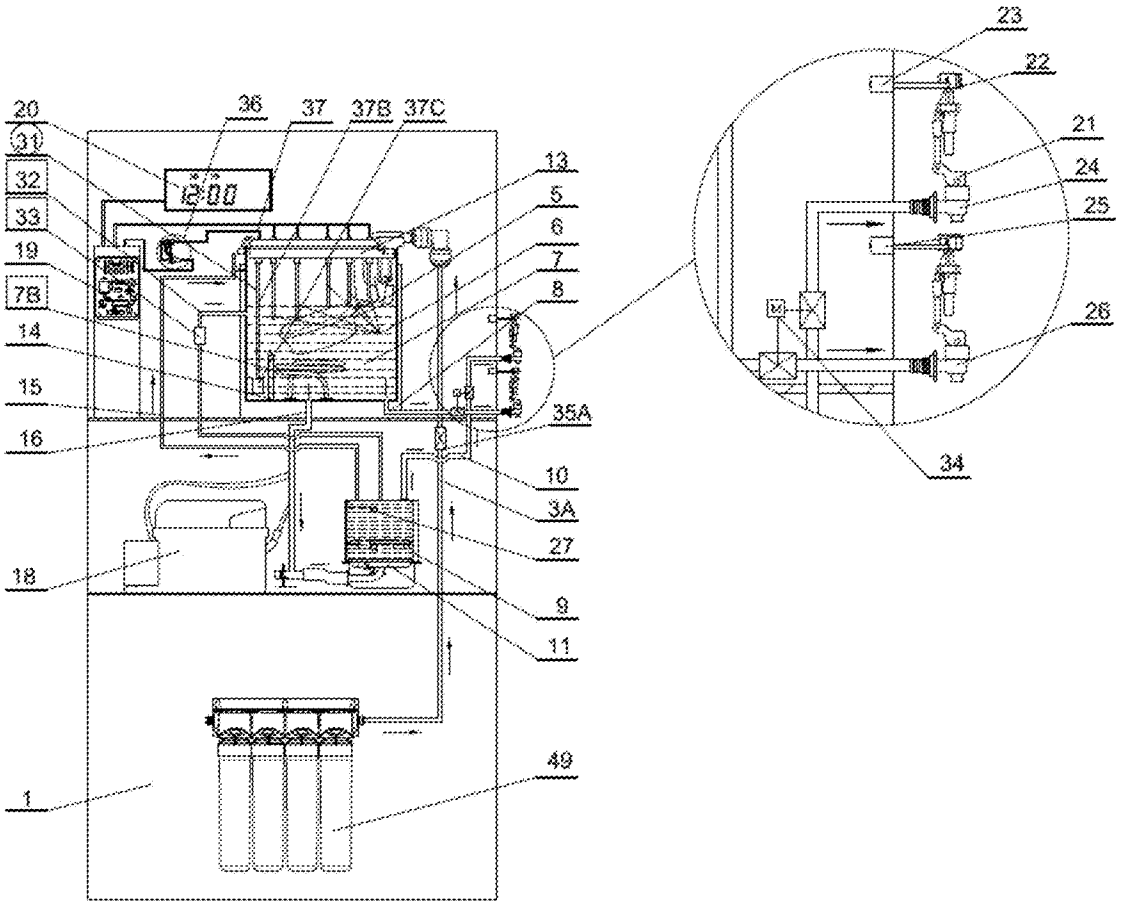
FIG. 18 is a diagram of another bottled water dispenser that includes an ozone generator and (optionally) a UV lamp, which includes a water pump that is configured and operated to cause cold water in the cold tank to mix with the hot water of the hot tank.

As with the other embodiments described herein, the water of the cold tank (7) may be heated during a sanitization procedure in various ways. For example, as shown in FIG. 15, a solenoid valve (17) may be in-line between the hot tank (9) and cold tank (7), which the electronic control board (19) can open (and later close) to permit hot water to enter the cold tank (7). Alternatively, as shown in FIG. 16, a heating element (29) may be disposed within the cold tank (7) and attached and suspended from the lid (13) of the cold tank (7)—or, as shown in FIG. 17, a heating element (30) may be attached to the floor of the cold tank (7). In still another embodiment, as shown in FIG. 18, the bottled water dispensers of the present invention may include a recirculating water pump (33) that is configured and operated to force cold water in the cold tank (7) to mix with the hot water of the hot tank (9). In other words, in such embodiments, the pump (33) provides a force that is imparted (at the instruction of the electronic control board (19) during a sanitization cycle) to force water to travel from one tank (e.g., the hot tank (9)) to another (e.g., the cold tank (7)) via a dedicated tube (32), instead of such mixing occurring by way of convection forces. In the embodiments shown in FIGS. 15-19, in addition to having a hot water sanitization feature, the ozone source/ozone generator (36) will provide yet another means for sterilizing the water and internal surfaces within the cold tank (7)—along with, optionally, a UV lamp (35A) positioned in-line with tube (3A), such that the filtered water is exposed to UV radiation prior to entering the cold tank (7).

Figure 19:
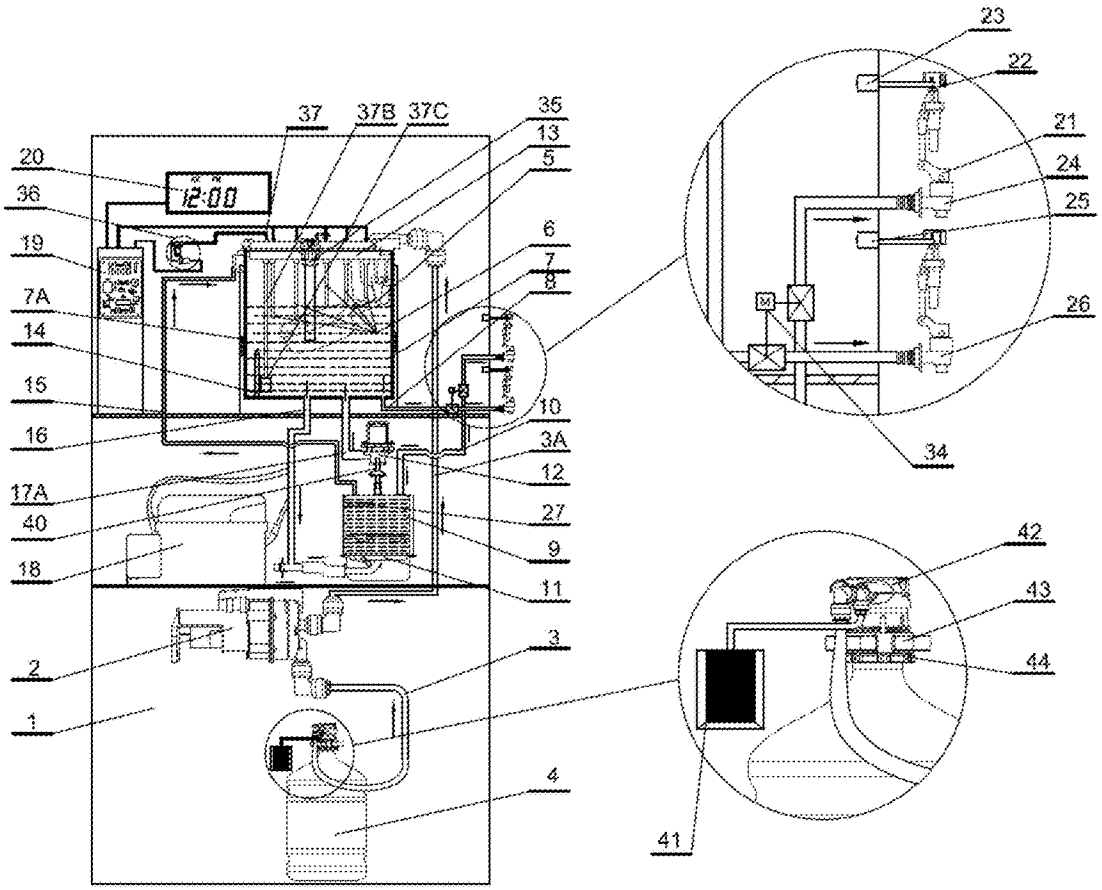
FIG. 19 is a diagram of another bottled water dispenser that includes an ozone generator, which further includes a filter connected to the probe that is disposed in the water bottle (which is configured to filter incoming air).

Referring now to FIG. 19, in yet further embodiments, an anti-bacterial filter (41) may be attached to the head (42) of the probe (which is disposed within the water bottle (4)). The invention provides that the anti-bacterial filter (41) is configured to filter and remove contaminants from incoming air, including airborne bacteria. The filter (41) may be comprised of block carbon (but could also be comprised of other suitable filter materials), along with silver or other medias that are designed to filter or destroy airborne bacteria (e.g., KDF® filters which are comprised of copper and zinc alloys). The filter (41) preferably includes a seal (44) and nut (43) to secure the filter (41) to the probe head (42), to ensure that the seal around the water bottle (4) is tight.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A bottom-loading bottled water dispenser that comprises a cabinet that houses:

(a) a bottle that may be reversibly placed within and on a floor of the cabinet, wherein the bottle contains a volume of water and is operably connected to a pump that is configured to extract water from the bottle and force the water through one or more tubes and into a cold tank, wherein the cold tank is attached to an evaporator that is configured to chill the water in the cold tank;

(b) a hot tank that is fluidly coupled to the cold tank through one or more tubes, wherein the hot tank is attached to a heating element that is configured to heat the water in the hot tank;

(c) a first external faucet that is fluidly coupled to the cold tank and a second external faucet that is fluidly coupled to the hot tank; and (d) an electronic control board that is configured to perform a sanitization procedure by causing a volume of water contained in the cold tank to be heated above a defined threshold temperature for a defined period of time that is effective to sanitize internal surfaces of the cold tank, wherein the first external faucet that is fluidly coupled to the cold tank is prevented from dispensing water during the sanitization procedure when the electronic control board activates a solenoid plunger valve, or closes a solenoid water valve, which prevents the first external faucet from being operated to dispense water, wherein the electronic control board is further configured to heat the volume of water contained in the cold tank by causing (i) a valve located within a dedicated tube that fluidly couples the hot tank to the cold tank to convert to an open position; and (ii) hot water to flow from the hot tank and into the cold tank through the dedicated tube.

2. The bottom-loading bottled water dispenser of claim 1, wherein the electronic control board is configured to heat the volume of water contained in the cold tank by activating a heating element located within the cold tank.

3. The bottom-loading bottled water dispenser of claim 1, wherein the electronic control board is configured to heat the volume of water contained in the cold tank by activating a circulating pump to force water from the hot tank and into the cold tank through a dedicated tube.

4. The bottom-loading bottled water dispenser of claim 1, wherein the electronic control board is programmed to heat the volume of water contained in the cold tank to execute a sanitization procedure (i) during a defined period of time of a specified day or set of days or (ii) upon the instruction of a user of the water dispenser.

5. The bottom-loading bottled water dispenser of claim 4, wherein the first external faucet is prevented from dispensing water during a sanitization procedure by (a) an operably coupled solenoid plunger valve that, when instructed by the electronic control board, is configured to engage with an actuator of the first external faucet that mechanically prevents the first external faucet from being operated by a user to dispense water from the cold tank or (b) an operably coupled solenoid water valve that, when instructed by the electronic control board, is configured to convert to a closed position that prevents the first external faucet from being operated by a user to dispense water from the cold tank.

6. The bottom-loading bottled water dispenser of claim 5, wherein the electronic control board is programmed to deactivate a compressor that is coupled to the evaporator during a sanitization procedure.

7. The bottom-loading bottled water dispenser of claim 6, wherein the electronic control board is programmed to intermittently activate and deactivate the compressor following a sanitization procedure, wherein a frequency or duration of compressor activations increases as water in the cold tank approaches a defined lower threshold.

8. The bottom-loading bottled water dispenser of claim 7, wherein the evaporator is attached to an exterior surface of the cold tank.

9. A bottom-loading bottled water dispenser that comprises a cabinet that houses:

(a) a bottle that may be reversibly placed within and on a floor of the cabinet, wherein the bottle contains a volume of water and is operably connected to a pump that is configured to extract water from the bottle and force the water through one or more tubes and into a cold tank, wherein the cold tank comprises or is attached to an evaporator that is configured to chill the water in the cold tank;

(b) a hot tank that is fluidly coupled to the cold tank through one or more tubes, wherein the hot tank is attached to a heating element that is configured to heat the water in the hot tank;

(c) a first external faucet that is fluidly coupled to the cold tank and a second external faucet that is fluidly coupled to the hot tank;

(d) an electronic control board that is configured to cause a volume of water contained in the cold tank to be heated above a defined threshold temperature for a defined period of time that is effective to sanitize internal surfaces of the cold tank; and (e) an ultraviolet (UV) lamp positioned in-line and contiguous with a delivery tube that carries water from the bottle to the cold tank, wherein the ultraviolet (UV) lamp is configured to expose water passing through the delivery tube to sanitizing ultraviolet (UV) radiation, wherein the electronic control board is configured to heat the volume of water contained in the cold tank by causing (i) a valve located within a dedicated tube that fluidly couples the hot tank to the cold tank to convert to an open position; and (ii) hot water to flow from the hot tank and into the cold tank through the dedicated tube.

10. The bottom-loading bottled water dispenser of claim 9, wherein the electronic control board is configured to heat the volume of water contained in the cold tank by activating a heating element located within the cold tank.

11. The bottom-loading bottled water dispenser of claim 9, wherein the electronic control board is configured to heat the volume of water contained in the cold tank by activating a circulating pump to force water from the hot tank and into the cold tank through a dedicated tube.

12. The bottom-loading bottled water dispenser of claim 11, wherein the electronic control board is programmed to heat the volume of water contained in the cold tank to execute a sanitization procedure (i) during a defined period of time of a specified day or set of days or (ii) upon the instruction of a user of the water dispenser.

13. The bottom-loading bottled water dispenser of claim 12, wherein the first external faucet that is fluidly coupled to the cold tank is prevented from dispensing water during a sanitization procedure.

14. The bottom-loading bottled water dispenser of claim 13, wherein the first external faucet is prevented from dispensing water during a sanitization procedure by (a) an operably coupled solenoid plunger valve that, when instructed by the electronic control board, is configured to engage with an actuator of the first external faucet that mechanically prevents the first external faucet from being operated by a user to dispense water from the cold tank or (b) an operably coupled solenoid water valve that, when instructed by the electronic control board, is configured to convert to a closed position that prevents the first external faucet from being operated by a user to dispense water from the cold tank.

15. The bottom-loading bottled water dispenser of claim 14, wherein the electronic control board is programmed to deactivate a compressor that is coupled to the evaporator during a sanitization procedure.

* * * * *